US007036539B2

(12) United States Patent
Sherman et al.

(10) Patent No.: US 7,036,539 B2
(45) Date of Patent: May 2, 2006

(54) AIR COOLED ROUTER BIT

(75) Inventors: Michael M. Sherman, Mooresville, NC (US); Jeremy A. Lowder, Boone, NC (US); Russell E. Cook, West Jefferson, NC (US)

(73) Assignee: Black & Decker Inc., Newark, DE (US)

( * ) Notice: Subject to any disclaimer, the term of this patent is extended or adjusted under 35 U.S.C. 154(b) by 184 days.

(21) Appl. No.: 10/667,100

(22) Filed: Sep. 17, 2003

(65) Prior Publication Data

US 2004/0096281 A1 May 20, 2004

Related U.S. Application Data

(60) Provisional application No. 60/411,705, filed on Sep. 18, 2002.

(51) Int. Cl.
*B27C 1/00* (2006.01)
*B27C 5/00* (2006.01)
*B27G 13/00* (2006.01)

(52) U.S. Cl. ..... 144/241; 144/154.5; 407/11; 407/56

(58) Field of Classification Search ..... 144/241, 144/240, 136.9, 154.5; 407/11, 56; 408/57, 408/59

See application file for complete search history.

(56) References Cited

U.S. PATENT DOCUMENTS 960,526 A * 6/1910 Erlandsen ..... 407/11
2,411,209 A * 11/1946 Furth et al. ..... 15/104.09
2,554,783 A * 5/1951 Lee ..... 407/11
2,678,487 A * 5/1954 Onsrud ..... 407/36
2,718,689 A 9/1955 Mason et al.
3,293,727 A 12/1966 Simms
4,728,231 A * 3/1988 Kunimori et al. ..... 408/59
5,346,335 A 9/1994 Harpaz et al.
5,478,176 A * 12/1995 Stedt et al. ..... 408/59
5,662,435 A 9/1997 Sherman
5,865,574 A * 2/1999 Tukala ..... 408/57
5,904,452 A 5/1999 Kress
5,947,653 A 9/1999 Hamberg
5,993,119 A 11/1999 Moller
6,045,301 A * 4/2000 Kammermeier et al. ..... 408/57
6,053,669 A 4/2000 Lagerberg

* cited by examiner

*Primary Examiner*—Bena Miller
(74) *Attorney, Agent, or Firm*—Sand & Sebolt

(57) ABSTRACT

A cutter bit includes a body formed integrally with a mounting shank. The body defines a pair of chip boxes with two planar surfaces and a cutting knife mounted to one of the planar surfaces of each chip box. The body defines holes from the chip boxes to the outer surface of the body, said holes communicating with grooves formed along the outer surface of the body such that a continuous air passage is formed circumferentially around the body by each hole and respective groove. The air passages cool the cutter bit as well as quickly remove material chips from the cutting edge and workpiece. The rapid removal of the chips also allows a better view of the cutting edge and the workpiece. The lack of material in the holes and grooves reduces cutter bit weight, allowing use with smaller motors and reducing the loads associated with cutting operations.

28 Claims, 3 Drawing Sheets

FIG-3
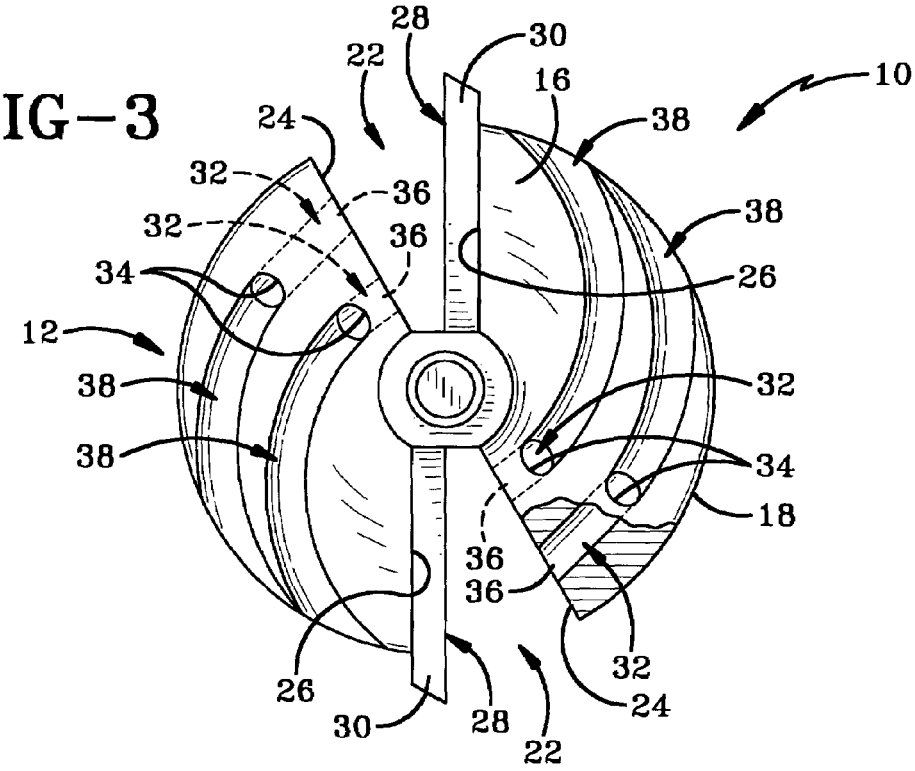
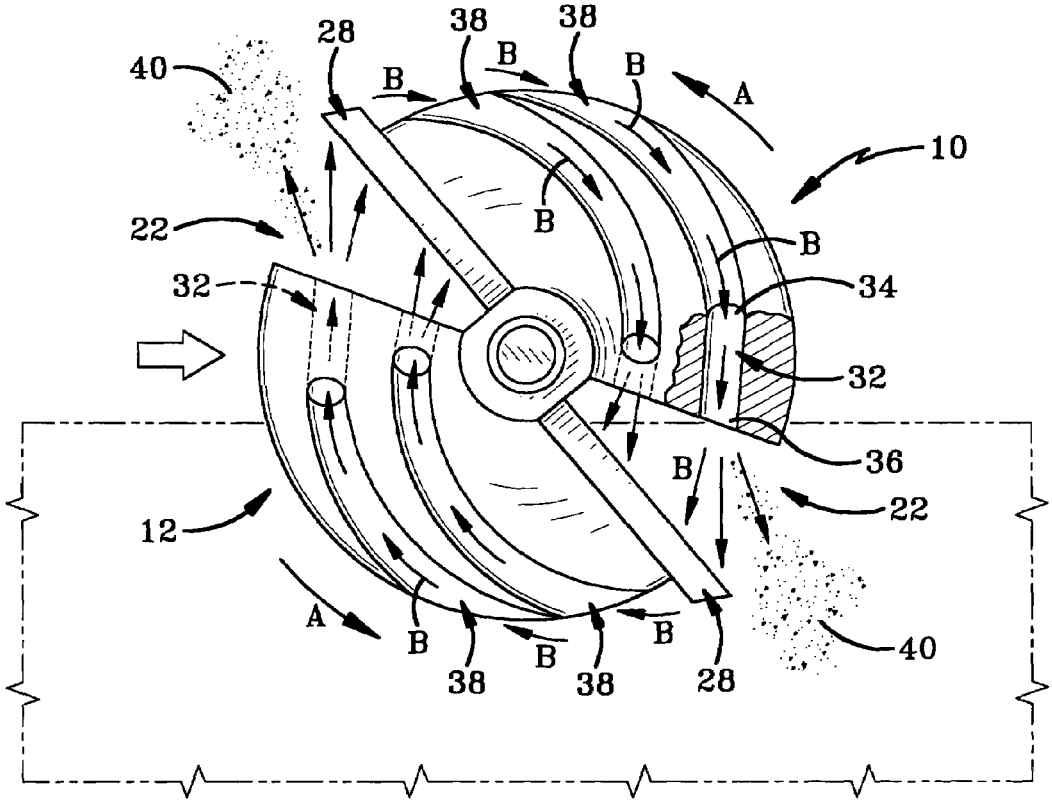
FIG-4

AIR COOLED ROUTER BIT

CROSS SECTION TO RELATED APPLICATION

This application claims priority from U.S. Provisional Application Ser. No. 60/411,705 filed Sep. 18, 2002; the disclosures of which are incorporated herein by reference.

BACKGROUND OF THE INVENTION

1. Technical Field

The invention relates generally to an improved cutter bit. More particularly, the invention relates to shaft mounted rotary cutter bits of the type mounted in rotary woodworking machines. Specifically, the invention relates to rotary cutting bits having increased cooling capacity and reduced weight during operation.

2. Background Information

It is customary in building construction, as well as the construction of furniture and cabinetry to impart decorative profiles upon the wood. Moreover, many joints are created by imparting a variety of profiles on the wood to create stronger joints, as well as to provide increased surface areas for glue contact at the joint. Regardless of the reasons of imparting a profile on the wood, the profile may be created in one of two methods. Hand planes may be utilized, which planes have a cutting knife shaped with a negative of the profile to be imparted on the wood. However, such planes are expensive, inaccurate and require significant skill to utilize. As such, many power tools have been specifically designed to impart a desired profile onto a workpiece while existing tools have been modified to allow those tools to also impart the desired profile.

While many such tools exist, routers are by far the most prevalent. Routers include a motor which rotates a chuck at a predetermined or variable speed. When the router operator wishes to impart a given profile onto a workpiece, the shank of a router bit having the desired profile is installed into the chuck. When the motor is activated, the router bit will rotate with each blade of the bit removing material from the workpiece creating the desired profile. Other cutting tools, such as shapers, provide a similar effect with only the connection between the cutter bit and tool varying.

As woodworking becomes increasingly popular in the hobby market, and competition increases in the industrial market, a significant number of cutter bits, each presenting a corresponding profile, have been developed. Additionally, as the size of routers continues to increase, cutter bits having increasingly complicated and larger profiles are being manufactured. Moreover, a number of bits have been introduced which present multiple profiles depending upon which portion of the bit is in contact with the workpiece.

An important problem associated with larger and more complicated cutter bits for use with router motors is heat build-up within the router bit body. Specifically, when a cutter bit is utilized to impart profiles upon a workpiece at high volume, or alternatively when the workpiece is extremely hard, significant heat may build up in the router bit substantially reducing router bit life. While holes drilled through the router body have been used to reduce the weight of the router bit (addressed below) and to reduce heat within the router body to a limited degree, the need exists for an effective method of removing heat from a router bit in an effort to assure that the cutting tool remains at relatively constant temperature during stressful routing operations. The effective removal of heat from the router bit is of primary concern herein.

In addition, when a cutter bit is in use, the router motor is loaded in a variety of ways. As the cutter bit impinges upon the workpiece and material is removed to create the desired profile, the resistance resulting from the cutting action loads the router motor. Additionally, the weight of the cutter bit itself adds significant load to the router motor. While the load that is a result of cutting action may be substantially reduced by assuring that the cutter bit remains sharp, and has correct bevel angles to remove material chips, the second load, resulting from cutter bit weight, may be reduced only by reducing the weight of the cutter bit.

This second load, which results from cutter bit weight, is also of primary concern herein. This load is insignificant when the cutter bit is small, or when the majority of the cutter bit mass is very near the cutter bit axis of rotation. However, for larger, or more complicated profiles such as multi-profile cutter bits, the cutter bit mass can be significant, with a significant portion thereof being positioned substantially away from the axis of rotation of the cutter bit thereby substantially increasing router motor load as a result of centrifugal force.

Additionally, even when a cutter bit is sharp, and appropriately beveled for chip removal, the cutter bit may nonetheless be loaded with material chips substantially increasing forces felt by the router motor and decreasing the effectiveness of the cutter bit. Additionally, when chips remain positioned adjacent the cutter bit, it is difficult for the user to see the cutting operation. The rapid removal of chips from adjacent the cutter bit is also of primary concern herein.

Thus, the need exists for a cutter bit having a body which significantly increases heat transfer to the surrounding atmosphere during operation and which also has a reduced weight. The need further exists for a cutter bit which assists in removing the chips from adjacent the cutting area, and which quickly unloads chips to the surrounding work surface.

BRIEF SUMMARY OF THE INVENTION

Advantages of the invention include providing a cutter bit cooled by air.

A further advantage is to provide a cutter bit with air passages formed by combination of holes and grooves extending circumferentially around the body of the cutter bit.

Yet another advantage is to provide a means for quickly removing material chips from adjacent the cutting area to produce more efficient cutting action and to provide additional cooling of the cutter bit, as well as provide a clearer view of the workpiece and cutting edge.

A still further advantage is to provide a cutter bit wherein the amount of weight positioned away from the axis of rotation of the cutter bit is reduced.

A further advantage is to provide such a cutter bit which is of simple construction, which achieves the stated objectives in a simple, effective and inexpensive manner, and which solves problems and satisfies needs existing in the art.

These and other advantages and features of the invention are obtained by the improved cutter bit, the general nature of which may be stated as including a body formed with an axial length; at least one cutting knife carried by the body; at least one chip box; mounting means adapted for mounting the cutter bit to a motor; at least one air passage consisting of a combination of a hole formed in the body which extends from a chip box to the outer surface of the body and communicates with a groove formed in the body along the outer surface of the body, said groove extending circumferentially at least partially around the body and terminating either at the leading edge of a chip box or at the outer edge of body.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 3 is a top plan view of the cutter bit of the present invention cut away and shown in section;

FIG. 4 is a top plan view of the cutter bit of the present invention with portions cut away and shown in section indicating rotational direction of cutter bit and direction of air flow and material chips;

Similar numerals refer to similar parts throughout the drawings.

DETAILED DESCRIPTION OF THE INVENTION

Figure 1:
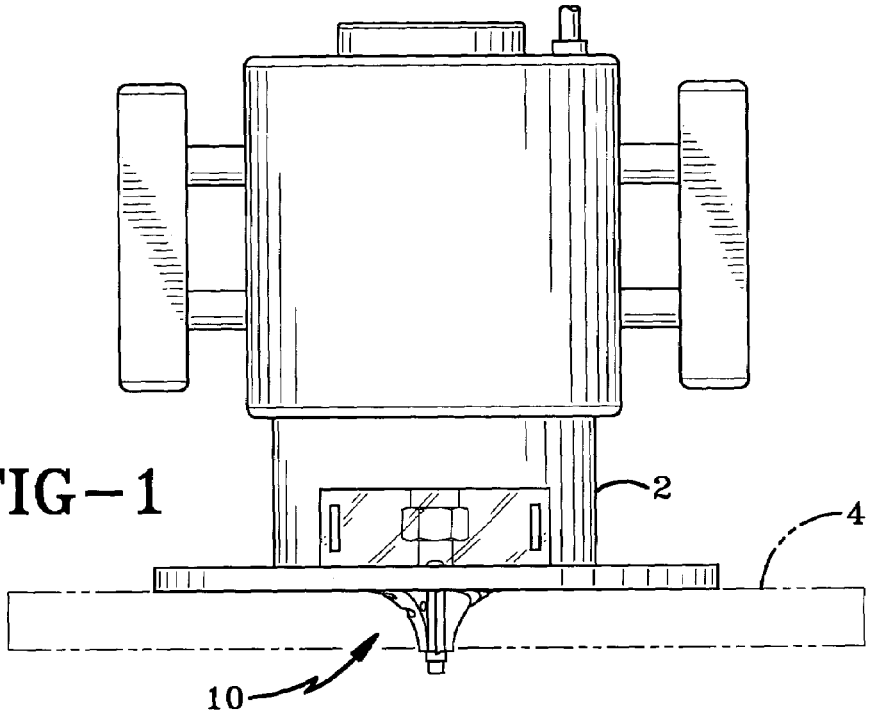
FIG. 1 is a schematic view of the cutter bit of the present invention as it would be attached to a motor.

The improved cutter bit of the present invention is indicated generally at 10 and is shown in FIG. 1 attached to a router motor 2, which is situated atop workpiece 4 so that cutter bit 10 is positioned for cutting a profile on an edge of workpiece 4.

Figure 2:
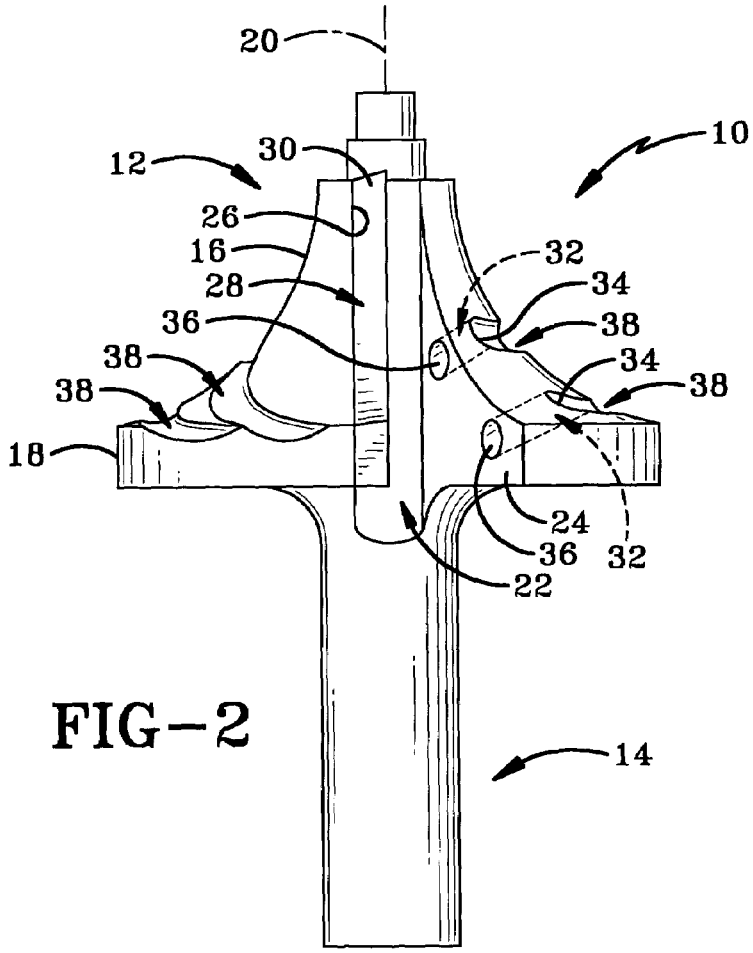
FIG. 2 is a side elevational view of the cutter bit of the present invention.

The improved cutter bit of the present invention is particularly shown in FIG. 2. Cutter bit 10 includes a body 12 and a mounting shank 14 extending outwardly from body 12. Body 12 is integrally formed with mounting shank 14.

Body 12 is formed with an outer surface 16, outer edge 18 and an axis of rotation 20. Additionally, body 12 is formed with a pair of opposing chip boxes 22 each having a planar leading surface 24 and a planar trailing surface 26. One cutting knife 28 is attached to body 12 adjacent each planar trailing surface 26. Cutting knives 28 are formed with a profile edge 30 for removing material from the workpiece.

In accordance with one of the main features of the present invention, and referring specifically to FIGS. 2–4, air passages are formed as a combination of a pair of holes 32 formed in body 12 and a pair of grooves 38 formed in body 12 along outer surface 16 of body 12. Holes 32 have leading ends 34 and trailing ends 36 and extend from outer surface 16 and are in communication with chip boxes 22. Leading ends 34 communicate with outer surface 16 and trailing ends 36 communicate with planar leading surfaces 24 of chip boxes 22. Grooves 38 are angularly oriented relative to axis of rotation 20 and extend circumferentially from leading ends 34 of respective holes 32 in body 12 partially around body 12 and terminate at outer edge 18 of body 12. Grooves 38 communicate with leading ends 34 of holes 32. Holes 32 are cylindrical and grooves 38 are fluted. Each hole 32 and respective groove 38 together form a continuous air passage.

If desired, grooves 38 can terminate at cutting knife 28, or alternatively may terminate partially at cutting knife 28 and partially at outer edge 18 of body 12 without departing from the conception of the invention. Similarly, the angular orientation of grooves 38 relative to axis of rotation 20 may be either constant or variable. The preferred inclination of the angular orientation is in a range from 5 (five) degrees to 90 (ninety) degrees. More preferably, the inclination of the angular orientation is in a range from 10 (ten) degrees to 65 (sixty-five) degrees. Likewise, holes 32 and grooves 38 need not be cylindrical and fluted, respectively.

The air passages formed by holes 32 and grooves 38 serve several major purposes. As shown in FIG. 4, cutter bit 10 rotates around the axis of rotation 20 in the direction of arrows A so that air is forced through said air passages as indicated by arrows B and functions to cool cutter bit 10 substantially more effectively than a conventional cutter bit. Further, the air passages allow material chips 40 to be removed more quickly than with a conventional cutter bit. Further, the lack of material in holes 32 and grooves 38 reduces the weight of cutter bit 10 positioned away from axis of rotation 20.

Figure 6:
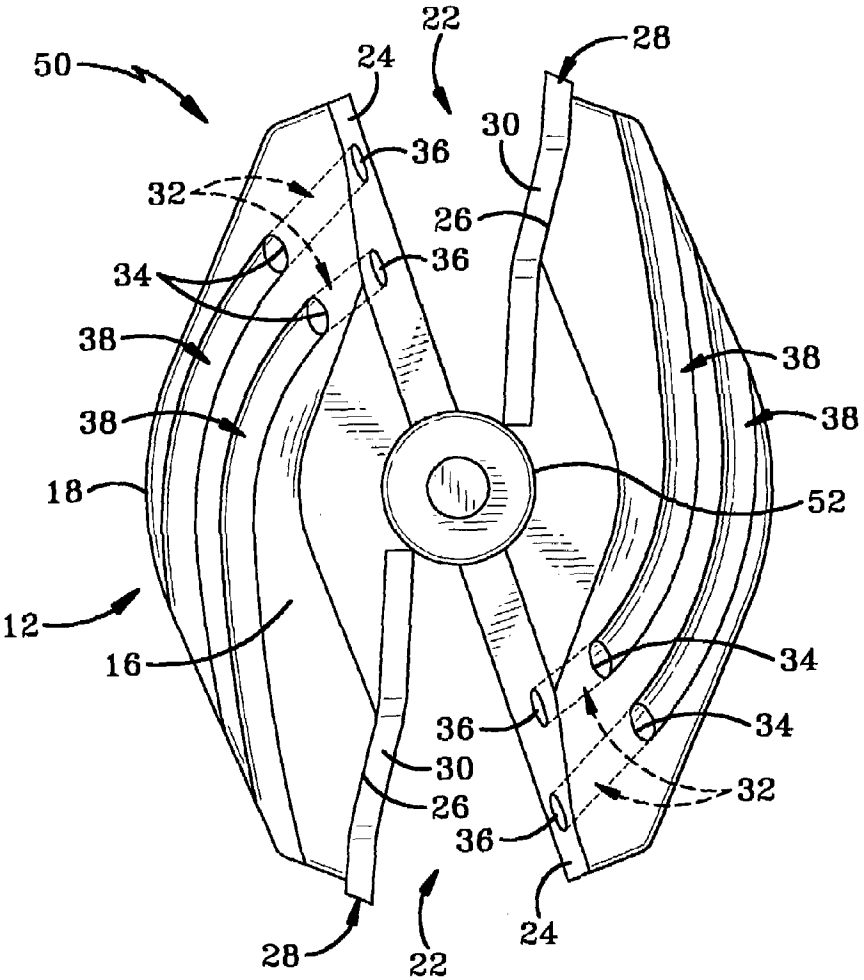
FIG. 6 is a top plan view of the cutter bit of a second embodiment of the present invention showing an alternate profile.
Figure 5:
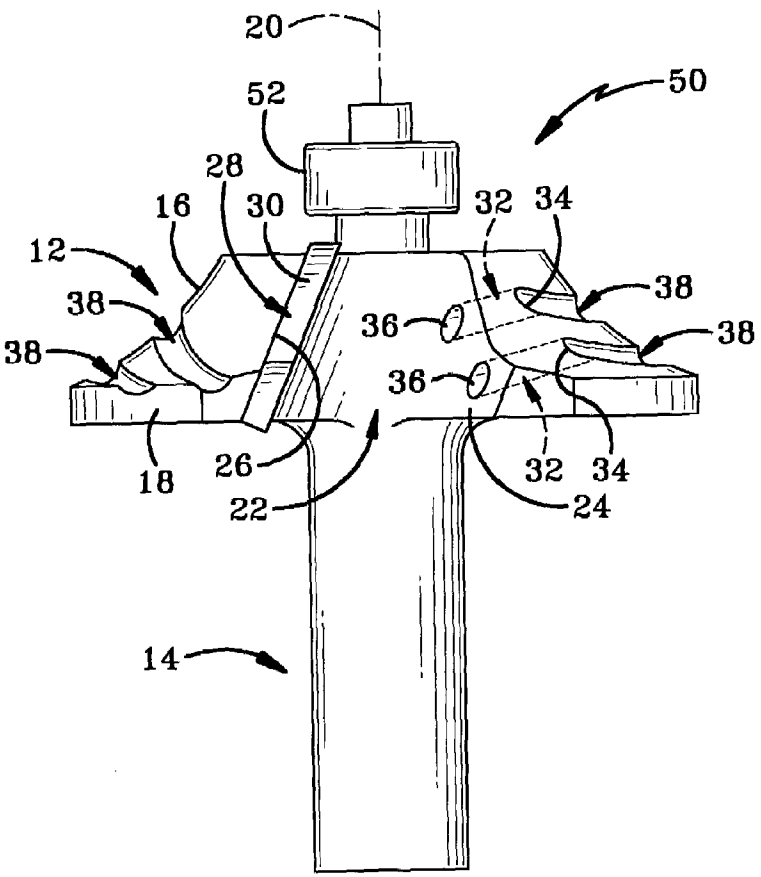
FIG. 5 is a side elevational view of the cutter bit of the present invention showing an alternate profile.

An improved cutter bit of the present invention with an alternate profile is indicated generally at 50 and is shown particularly in FIGS. 5–6. Cutter bit 50 is similar to cutter bit 10 in most respects and corresponding parts are similarly numbered. Cutter bit 50 shows various structural differences common to conventional cutter bits with which the air passages of the present invention may also be utilized. For instance, cutter bit 50 shows a cutting knife 28 angled as shown in FIG. 5. Cutter bit 50 also contemplates various profile edge 30 shapes. Further, the cross-section of body 12 taken perpendicular to axis of rotation 20 can have various shapes. Finally, cutter bit 50 indicates the option of using a bearing 52 opposite mounting shank 14 for additional support.

Accordingly, the improved cutter bit is simplified, provides an effective, safe, inexpensive, and efficient device which achieves all the enumerated advantages, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cutter bit is constructed and used, the characteristics of the construction, and the advantageous, new and useful results obtained; the new and useful structures, devices, elements, arrangements, parts and combinations are set forth in the appended claims.

The invention claimed is:

1. A rotary cutter bit for imparting a profile to a workpiece comprising:

a body formed with an axial length and having an outer surface and an outer edge;

at least one cutting knife formed with a profile edge carried by the body;

a shank carried by the body adapted for mounting the cutter bit to a motor;

at least one chip box formed in the body; and the body defining at least one hole extending at least partially circumferentially around the body and in communication with the at least one chip box.

2. The rotary cutter bit as defined in claim 1 in which the at least one hole has a leading end and a trailing end and the leading end of the at least one hole communicates with the outer surface of the body and the trailing end of the at least one hole communicates with the chip box.

3. The rotary cutter bit as defined in claim 1 in which the at least one hole is cylindrical.

4. The rotary cutter bit as defined in claim 1 in which a bearing is attached to the body opposite the shank.

5. The rotary cutter bit as defined in claim 1 in which the shank extends outwardly from the body.

6. The rotary cutter bit as defined in claim 1 in which there are a plurality of cutting knives, each of which is formed with a profile edge; in which a chip box is associated with each cutting knife; and in which at least one hole is associated with each chip box and extends from the outer surface of the body and is in communication with the associated chip box whereby each hole has a leading end and a trailing end.

7. The rotary cutter bit as defined in claim 1 in which the at least one chip box includes a leading surface from which the at least one hole extends.

8. The rotary cutter bit as defined in claim 7 in which the leading surface is planar.

9. The rotary cutter bit as defined in claim 1 in which at least one groove is formed in the body along the outer surface of the body and extends circumferentially at least partially around the body.

10. The rotary cutter bit as defined in claim 9 in which the at least one groove communicates with the leading end of the at least one hole.

11. The rotary cutter bit as defined in claim 9 in which the at least one groove terminates at one of the cutting knife and the outer edge of the body.

12. The rotary cutter bit as defined in claim 9 in which the at least one groove terminates partially at the cutting knife and partially at the outer edge of the body.

13. The rotary cutter bit as defined in claim 9 in which there are a plurality of cutting knives, each of which is formed with a profile edge; in which a chip box is associated with each cutting knife; in which at least one hole is associated with each chip box and extends from the outer surface of the body and is in communication with the associated chip box whereby each hole has a leading end and a trailing end; and in which one groove communicates with each hole and extends to one of a cutting knife not associated with said chip box and the outer edge of the body adjacent a cutting knife not associated with said chip box.

14. The rotary cutter bit as defined in claim 9 in which the at least one groove is fluted.

15. The rotary cutter bit as defined in claim 9 in which the body is formed with an axis of rotation.

16. The rotary cutter bit as defined in claim 15 in which the at least one groove is angularly oriented relative to the axis of rotation.

17. The rotary cutter bit as defined in claim 16 in which the angular orientation is constant.

18. The rotary cutter bit as defined in claim 16 in which the angular orientation is variable.

19. The rotary cutter bit as defined in claim 16 in which the angularly oriented at least one groove is inclined in a range from 5 degrees to 90 degrees.

20. The rotary cutter bit as defined in claim 16 in which the angularly oriented at least one groove is inclined in a range from 10 degrees to 65 degrees.

21. A rotary cutter bit for imparting a profile to a workpiece comprising:

a body formed with an axial length and having an outer surface and an outer edge; the body being formed with an axis of rotation;

at least one cutting knife formed with a profile edge carried by the body;

a shank carried by the body adapted for mounting the cutter bit to a motor;

at least one chip box formed in the body; and the body defining at least one hole; and wherein said hole having a longitudinal axis; and the longitudinal axis of the hole does not intersect the axis of rotation of the body.

22. The rotary cutter bit as defined in claim 21 in which the at least one hole has a leading end and a trailing end and the leading end of the at least one hole communicates with the outer surface of the body and the trailing end of the at least one hole communicates with the chip box.

23. The rotary cutter bit as defined in claim 21 in which there are a plurality of cutting knives, each of which is formed with a profile edge; in which a chip box is associated with each cutting knife; and in which at least one hole is associated with each chip box and extends from the outer surface of the body and is in communication with the associated chip box; whereby each hole has a leading end and a trailing end has a centerline and the centerline does not intersect the axis of rotation of the body.

24. The rotary cutter bit as defined in claim 21 in which at least one groove is formed in the body along the outer surface of the body and extends circumferentially at least partially around the body and communicates with the leading end of the at least one hole.

25. The rotary cutter bit as defined in claim 24 in which the at least one groove is angularly oriented relative to the axis of rotation of the body.

26. The rotary cutter bit as defined in claim 25 in which the angularly oriented at least one groove is inclined in a range from 5 degrees to 90 degrees.

27. The rotary cutter bit as defined in claim 25 in which the angularly oriented at least one groove is inclined in a range from 10 degrees to 65.

28. The rotary cutter bit as defined in claim 21 in which there are a plurality of cutting knives, each of which is formed with a profile edge; in which a chip box is associated with each cutting knife; in which at least one hole is associated with each chip box and extends from the outer surface of the body and is in communication with the associated chip box whereby each hole has a leading end and a trailing end and has a centerline that does not intersect the axis of rotation of the body; and in which one groove communicates with each hole and extends to one of a cutting knife not associated with said chip box and the outer edge of the body adjacent a cutting knife not associated with said chip box.

* * * * *